United States Patent [19]

Lehrman

[11] 4,043,062

[45] Aug. 23, 1977

[54] IRONING PAD

[75] Inventor: David Lehrman, Cheltenham, Pa.

[73] Assignee: The Ironees Company, Philadelphia, Pa.

[21] Appl. No.: 690,228

[22] Filed: May 26, 1976

[51] Int. Cl.[2] ..... D06F 81/14

[52] U.S. Cl. ..... 38/140; 38/66; 428/71; 428/102; 428/310; 428/313

[58] Field of Search ..... 428/310, 311, 313, 314, 428/315, 102, 68, 69, 71, 74, 75, 76, 542; 38/140, 66

[56] References Cited

U.S. PATENT DOCUMENTS

| | | | |
|---|---|---|---|
| 3,414,995 | 12/1968 | Adiletta et al. | 38/140 |
| 3,733,724 | 5/1973 | Davis | 38/140 |
| 3,911,603 | 10/1975 | Lehrman | 38/140 |

*Primary Examiner*—William J. Van Balen
*Attorney, Agent, or Firm*—Seidel, Gonda & Goldhammer

[57] ABSTRACT

An ironing pad which is substantially smaller than a standard ironing board is adapted to be placed on top of a table or other support surface for ironing. The upper surface of the pad is comprised of a heat resistant fabric. This fabric is adhesively bonded to a layer of a heat resistant foam padding. The lower surface of the pad is comprised of a layer of skid resistant material and a layer of metal foil separates the foam padding from the skid resistant layer. The metal foil prevents heat and moisture from the iron from penetrating the pad and damaging the tabletop on which the pad is placed.

10 Claims, 3 Drawing Figures

FIG. 1
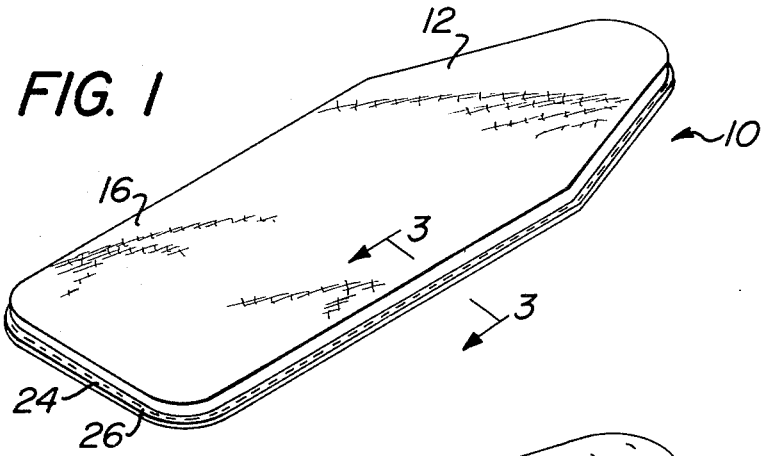
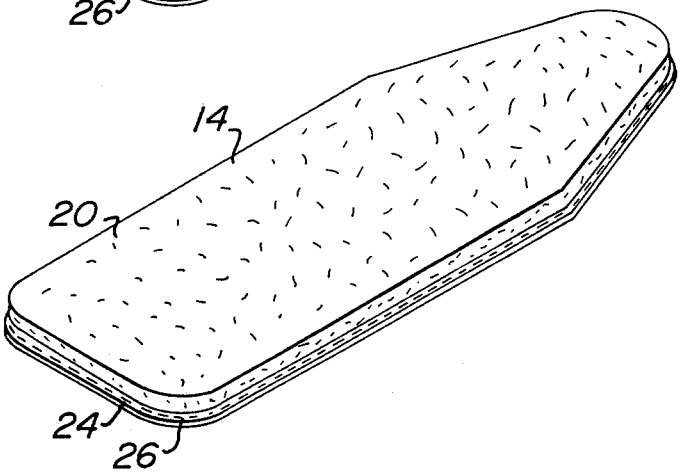
FIG. 2
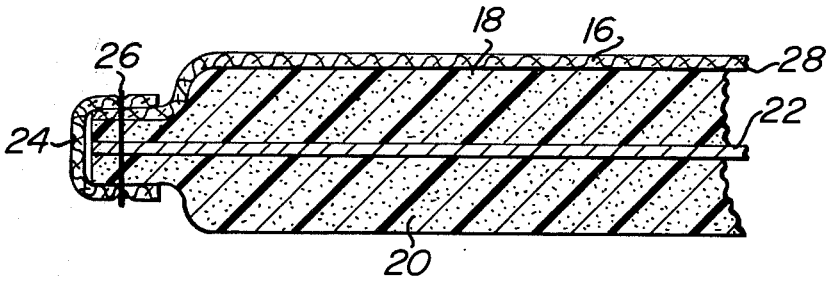
FIG. 3

IRONING PAD

This invention relates to an ironing pad and more particularly to an iron pad which is substantially smaller than a standard ironing board and which is adapted to be used on top of a table or other support surface for ironing.

In recent times, domestic ironing has been done on a wood or metal ironing board having surface dimensions of approximately 15 × 54 inches and which includes two or more folding support legs. The ironing board surface is normally covered with a separate pre-shaped pad which generally conforms to the size and shape of the ironing board surface. Conventional pads are made of foam, felt or other suitable compressible resilient padding and include a tailored cover which is similarly shaped but somewhat larger than the foam or felt so that when the pad is placed on the ironing board, the edges of the cover are brought down beneath the peripheral edges of the ironing board and are drawn tightly with the use of elastic, a draw cord, or similar device.

This upholstered apparatus was appropriate when the average household ironing chore represented one or two solid days per week. However, with the advent of permanent press materials, laundering is more frequent and distributed throughout the entire week. Therefore, the subsequent ironing operation is less scheduled on fixed days and most of the laundry requires little or no ironing. A conventional ironing board, in its folded state, is approximately 60 inches long, 15 inches wide, three inches thick and weighs between 12 and 15 pounds. Thus, the setting up, folding, storing and resetting up of conventional ironing boards has become a substantial nuisance in view of the sporadic times in which ironing is done today. The conventional ironing board is no longer convenient to use. This is particularly true when ironing may be done in different rooms, on different household levels or when traveling.

The present invention overcomes all of the deficiencies of conventional ironing boards and is substantially easier and more convenient to use. The ironing pad of the present invention weighs less than one pound and is substantially smaller than a standard ironing board. The pad is adapted to be placed on top of a table or other support surface for ironing and can be folded or rolled to reduce its size even further for storage. The pad is comprised of an outer layer of heat resistant fabric which is adhesively bonded to a layer of heat resistant foam padding. The lower surface of the pad includes a layer of skid resistant material and a layer of metal foil separates the foam padding from the skid resistant layer. The metal foil prevents heat and moisture from the iron from penetrating the pad and damaging the tabletop on which the pad is placed.

For the purpose of illustrating the invention, there is shown in the drawing a form which is presently preferred; it being understood, however, that this invention is not limited to the precise arrangements and instrumentalities shown.

BRIEF DESCRIPTION OF THE DRAWINGS

FIG. 1 is a top perspective view of an ironing pad constructed in accordance with the principles of the present invention;

FIG. 2 is a bottom perspective view of the ironing pad, and

FIG. 3 is an enlarged partial sectional view taken along the line 3—3 of FIG. 1.

DETAILED DESCRIPTION OF THE INVENTION

Referring now to the drawing in detail wherein like numerals are used throughout the several figures to designate like elements, there is shown an ironing pad constructed in accordance with the principles of the present invention and designated generally at 10. Iron pad 10 may have any desired shape but preferably has the same general outline of a conventional ironing board. The pad, however, is substantially smaller having a width, for example, of approximately 12 inches and a length of approximately 30 inches. As will be described more fully below, the pad 10 has a laminated structure, the overall thickness being approximately one-half inch. The foregoing dimensions are, of course, by way of example only.

Ironing pad 10 has an upper ironing surface 12 and a bottom slide-proof surface 14. Top surface 12 is comprised of a layer of fabric 16 which is made from a suitable material which will resist the heat and pressure normally applied during ironing. Such fabrics are well-known in the art and are readily available commerically. Thus, they will not be described in detail. Beneath the fabric layer 16 and bonded thereto is a layer of heat resistant padding 18 which is preferably a foam polymeric material such as foam polyurethane approximately one-quarter inch thick. The layer of padding 18 has approximately the same width and length dimensions as the fabric layer 16.

The bottom non-skid surface 14 of the pad 10 is comprised also of a layer of padding 20 which also is preferably a layer of foam polymeric material such as foam polyurethane and is approximately one-quarter inch thick. As a result of this layer of padding 20, the bottom surface 14 of the ironing pad has anti-skid characteristics so that it is immovably anchored during the back and forth and sideways ironing stroke movements by the user.

As best shown in FIG. 3, located between the padding layers 18 and 20 is a vapor and heat barrier layer 22. Layer 22 is preferably a sheet of aluminum foil but may be any suitable substitute material or coating. Layer 22 conforms to the dimensions of the ironing pad and serves to reflect heat from the iron back upwardly. In addition, layer 22 provides an effective limiting vapor and heat barrier and insulator so that penetrating steam and heat will not effect the tabletop or other support surface on which the ironing pad 10 is placed.

As stated above, each of the layers 16, 18, 20 and 22 have substantially the same width and length dimensions. Accordingly, the peripheral edges of each of the layers end at approximately the same location. This is best shown in FIG. 3. A strip of bias material 24 is folded about the peripheral edges of each of the layers of the pad 10 along the entire outer circumference of the pad. The binding together of the several layers of the pad is completed by sewing through the bias binding 24 and each of the layers of the pad 10 throughout the entire circumference of the pad such is shown at 26.

As stated above, the fabric layer 16 is secured to the layer of padding 18 by an adhesive such as shown at 28 in FIG. 3. The preferred adhesive is a thermoplastic polymer material with heat reactive cross linking groups such as NACRYLIC X-4260 (trademark) which is a self-reactive acrylic co-polymer latex. Such adhesive has a clarity of water white, a solid content of 51%, pH of 3.5, average particle size of 0.18 microns, anionic particle charge, excellent stability, density of 8.8 lbs/gal., and excellent water and solvent resistance.

Due to the adhesive bonding 28 between fabric layers 16 and padding 18, the laminate is wrinkle-proof. The laminate has increase tensile strength and abrasive resistance and is permanently locked together. During ironing, any handling or packaging wrinkles are ironed perfectly smooth by the automatic softening and rehardening of the adhesive used.

The preferred method of making the pad 10 involves the use of the thermoplastic adhesive described above applied to one face of padding 18 by conventional applicator rollers or the like. The padding 18 may be placed upon any suitable surface adapted to be reciprocated into a press. The fabric layer 16 is then placed over the padding 18.

The surface upon which the padding 18 is placed is then reciprocated into a conventional press. The top platen of the press (not shown) is heated to a temperature of approximately 300° F to 450° F with the preferred temperature being 425° F. Minimal pressure is applied when the platen is brought into contact with the outer face of the fabric 16. It is important that pressure be minimal in order to avoid substantial compression of the padding layer 18. Only the top 1/16 inch to ⅛ inch of the padding should be compressed so that the desired thickness of the padding 18 will be maintained. The exact pressure applied depends on the padding 18 used and may be easily visually determined by noting the pressure required to effect the desired minimum compression of the padding 18. Excessive pressure will result in crushing of the padding 18 during the bonding and curing steps with the adhesive being forced through the padding 18 and preventing the padding from recovering its original shape thereby resulting in an unacceptable ironing pad 10.

The top platen is held in place from approximately 3–8 seconds while the adhesive is cured with the optimum curing time being 5 seconds. No heat is applied through the bottom of the padding 18 since such heat would adversely affect the padding 18 during bonding. The preferred adhesive will soften at approximately 200° F to 500° F. It had been found, however, that softening of the adhesive does not cause delamination but rather the quality of the bond is increased. Most ironing is done with an iron heated to approximately 150° F to 300° F although higher ironing temperatures are employed for certain fabrics. Wrinkles in the upper surface 12 of pad 10 may be easily ironed out so that a wrinkle free surface can be maintained.

After the fabric layer 16 and padding 18 have been bonded together, the underside of padding 18 is then covered with a sheet of aluminum foil 22. And beneath the layer of foil 22 is placed the second layer of padding 20. Padding layers 18 and 20 may be adhesively bonded to the layer of aluminum foil 22 although this is not critical to the operation of the ironing pad 10. After the several layers of the laminate are assembled, the outer peripheral edges are bound together by stitching such as shown at 26 through the bias fabric 24, as explained above.

The present invention may be embodied in other specific forms without departing from the spirit or essential attributes thereof and, accordingly, reference should be made to the appended claims, rather than to the foregoing specification as indicating the scope of the invention.

I claim:

1. An ironing pad adapted to be placed on a support surface for ironing comprising an upper surface of heat resistant fabric, a layer of heat resistant padding underlying said fabric and being adhesively bonded thereto by a thermoplastic adhesive such that during ironing, softening of said adhesive occurs at about 200°–250° F, allowing the pad to be maintained in a wrinkle free condition, a vapor and heat barrier layer underlying said padding, skid resistant means on the bottom of said pad for preventing said pad from moving on said support surface during ironing and means for joining said fabric, said padding, said barrier layer and said skid resistant means together.

2. An ironing pad as claimed in claim 1 wherein said layer of heat resistant padding is a layer of foam polymeric material.

3. An ironing pad as claimed in claim 2 wherein said polymeric material is polyurethane.

4. An ironing pad as claimed in claim 1 wherein said skid resistant means comprises a layer of foam polymeric material.

5. An ironing pad as claimed in claim 4 wherein said polymeric material is polyurethane.

6. An ironing pad as claimed in claim 1 wherein said barrier layer comprises a layer of metal foil.

7. An ironing pad as claimed in claim 6 wherein said metal foil is aluminum foil.

8. An ironing pad as claimed in claim 1 wherein said means for joining joins said fabric, said padding, said barrier layer and said skid resistant means along substantially their entire outer peripheral edges.

9. An ironing pad as claimed in claim 8 wherein said outer peripheral edges are sewn together.

10. An ironing pad adapted to be placed on a support surface for ironing, comprising an upper surface of a layer of heat resistant fabric, a first layer of foam polymeric material underlying said fabric and being adhesively bonded thereto by a thermoplastic adhesive such that during ironing, softening of said adhesive occurs at about 200°–250° F, allowing the pad to be maintained in a wrinkle free condition, a vapor and heat barrier layer of metal foil underlying said first layer of foam polymeric material, a second layer of foam polymeric material underlying said metal foil and providing a skid resistant bottom for said pad for preventing the pad from moving on said support surface during ironing and means joining the peripheral edges of all of said layers of said pad together.

* * * * *